US007648266B2

(12) United States Patent
Saunier

(10) Patent No.: US 7,648,266 B2
(45) Date of Patent: Jan. 19, 2010

(54) CROWN PROTECTION DEVICE FOR WRISTWATCH

(75) Inventor: André Saunier, Courgenay (CH)

(73) Assignee: Tissot S.A., Le Locle (CH)

( * ) Notice: Subject to any disclaimer, the term of this patent is extended or adjusted under 35 U.S.C. 154(b) by 162 days.

(21) Appl. No.: 10/597,867

(22) PCT Filed: Feb. 1, 2005

(86) PCT No.: PCT/EP2005/000969

§ 371 (c)(1),
(2), (4) Date: Mar. 19, 2008

(87) PCT Pub. No.: WO2005/088410

PCT Pub. Date: Sep. 22, 2005

(65) Prior Publication Data

US 2009/0046542 A1 Feb. 19, 2009

(30) Foreign Application Priority Data

Feb. 10, 2004 (EP) ..... 04002939

(51) Int. Cl.
*G04B 37/00* (2006.01)

(52) U.S. Cl. ..... 368/286; 368/308

(58) Field of Classification Search ..... 368/216, 368/308, 286–290, 319–321, 281, 283
See application file for complete search history.

(56) References Cited

U.S. PATENT DOCUMENTS

D296,991 S * 8/1988 Lauper ..... D10/30
5,200,019 A * 4/1993 Brandis et al. ..... 156/523
6,210,034 B1 * 4/2001 Latini ..... 368/289
6,679,624 B1 * 1/2004 Mouawad ..... 368/216
7,001,064 B2 * 2/2006 Finazzi ..... 368/319
D576,055 S * 9/2008 Vaptzarof ..... D10/39
2005/0254353 A1 * 11/2005 Cogoli et al. ..... 368/281

FOREIGN PATENT DOCUMENTS

| | | |
|---|---|---|
| CH | 262 846 | 10/1949 |
| CH | 515 541 | 12/1971 |
| CH | 3 110/72 | 4/1975 |
| CH | 567 300 | 9/1975 |
| CH | 661 404 | 7/1987 |
| FR | 2 788 608 | 7/2000 |

OTHER PUBLICATIONS

International Search Report issued in corresponding application No. PCT/EP2005/000969, completed Dec. 7, 2005 and mailed Dec. 16, 2005.

* cited by examiner

*Primary Examiner*—Vit W Miska
*Assistant Examiner*—Sean Kayes
(74) *Attorney, Agent, or Firm*—Griffin & Szipl, P.C.

(57) ABSTRACT

The device includes a cover for concealing or revealing a crown, via a relative rotation of the crown and an external casing element. In a preferred embodiment, the cover is secured to a ring slide friction mounted in an annular groove at the base of the middle part and held in place by a washer provided with lugs in order to be screwed into the horns of the middle part.

15 Claims, 3 Drawing Sheets

CROWN PROTECTION DEVICE FOR WRISTWATCH

This is a National Phase Application in the United States of International Patent Application No. PCT/EP2005/000969 filed Feb. 1, 2005, which claims priority on European Patent Application No. 04002939.9, filed Feb. 10, 2004. The entire disclosures of the above patent applications are hereby incorporated by reference.

FIELD OF THE INVENTION

The present invention concerns a device for protecting the crown, and more generally any external control member, of a wristwatch when said crown is not being used, and conversely easily leaving the crown free when one wishes to use it.

BACKGROUND OF THE INVENTION

Devices that protect and conceal a crown when it is not being used, which means most of the time that a wristwatch is used, are already known. These devices are provided for essentially technical reasons, for example to prevent the crown catching and inadvertently switching on a function, or, even worse, damaging the winding stem.

The best known method consists of providing lugs on the middle part, on either side of the crown, said lugs extending as far as the head of the crown and only leaving one portion of the notched crown visible. A device of this type is clearly shown in the Figures of CH Patent No. 515 541, even though protection of the crown is not the feature of the invention concerned.

In addition to appearing unattractive, this solution has the drawback of making it awkward to manipulate the crown, particularly pulling it.

CH Patent No. 567 300 discloses a device for locking the push buttons and crown of a chronograph wristwatch by means of a cover secured to a rotating bezel including an extension extending beyond the middle part and including a vertical cylindrical wall substantially matching the height of the middle part. This solution is satisfactory for the desired object, but has the drawback of making the rotating bezel totally unusable for the usual functions of a rotating bezel.

SUMMARY OF THE INVENTION

It is thus an object of the present invention to overcome the drawbacks of the aforecited prior art by providing a crown and/or push button protection device for a wristwatch that leaves the control members completely clear when one wishes to use them, and conversely which efficiently protects them when they are not being used, without thereby adversely affecting access to the other control members, such as a rotating bezel.

The invention therefore concerns a crown protection device for a wristwatch including a movement whose functions are controlled by at least one crown at the end of a winding stem. When it is not being used, the crown can be concealed by a cover provided in a "two part" external casing formed by a middle part, closed on the dial side by a crystal surrounded by the bezel, by a back cover and by horns integral with one part of the external casing. The device is characterized in that the movement and the external casing, or an element integrated therein, can be manipulated in rotation relative to a position in which the crown is concealed by a cover and a position where it is revealed.

According to a first embodiment, the cover is secured to a manoeuvring ring slide friction mounted in an annular groove formed in the base of the middle part and held in place by a base provided with lugs screwed into the horns. This construction has the advantage of requiring very little modification to the external casing of any round wristwatch.

According to another embodiment, the movement is housed in a single shell case, and the back cover and horns together form a support in which the case can pivot to bring the crown into a cover formed in one horn. This construction also has the advantage of practically not altering the external appearance of the wristwatch and making the presence of any control member practically impossible to detect.

BRIEF DESCRIPTION OF THE DRAWINGS

Other features and advantages of the present invention will appear more clearly upon reading the following detailed description, with reference to the annexed drawings, in which.

DETAILED DESCRIPTION OF THE INVENTION

A first embodiment is described essentially with reference to FIGS. 1 to 8.

Figure 1:
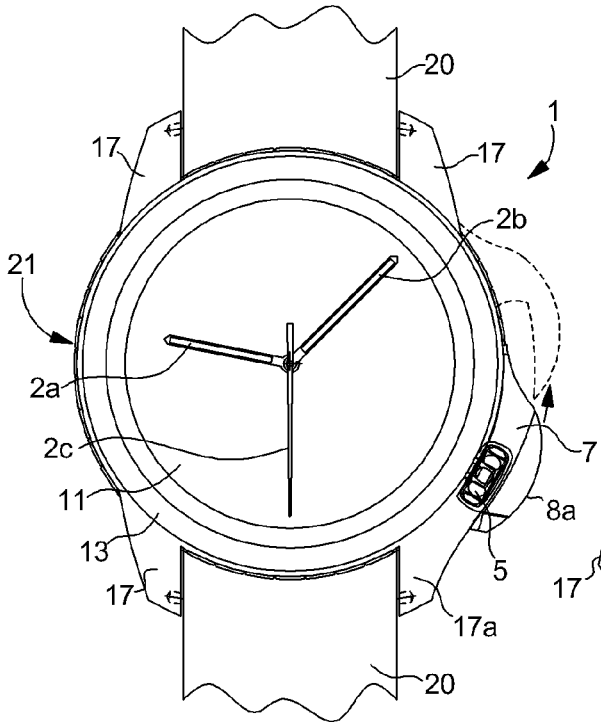
FIG. 1 shows a top view of a first embodiment of a crown cover device.

FIG. 1 shows a top view of a wristwatch 1 including a movement 3 and a winding stem 6 (both visible in the cross-section of FIG. 5), winding stem 6 including at its end a crown 5 positioned at 4 o'clock. Movement 3, which drives hour hand 2*a*, minute hand 2*b* and second hand 2*c* in a known manner above a dial 11, is housed in an external casing formed by a middle part 9 closed on the dial side 11 by a crystal 12 held by the top part of middle part 9, forming bezel 13. Middle part 9 is also provided with four horns 17, 17*a*, whose first function is to attach wristband or bracelet strands 20.

In the example shown, middle part 9 and bezel 13 form a single piece, but it is clear that this part of the external casing could be formed by two different pieces, with bezel 13 being a rotating bezel, if so desired.

Middle part 9 is closed on the dial side by a separate back cover 15, with the insertion of a "sanfil" sealing gasket, for example, to ensure water resistant sealing. Back cover 15 is for example screwed into a threading at the base of the middle part or snap fitted therein. As can be seen, in the cross-sections of FIGS. 5 to 8, the base of middle part 9 includes an annular groove 29 in which a ring 21 including an extension forming cover 7, is position. Ring 21 is slide friction mounted in annular groove 29, with a housing provided in its base for a sealing gasket 31, formed for example by a PTFE ring.

Ring 21 and sealing gasket 31 are held in place by a washer 26 abutting on the edges of annular groove 29 and including four securing lugs 16 extending underneath horns 17, 17*a* to allow said washer 26 to be secured by means of screws 19.

Figure 9:
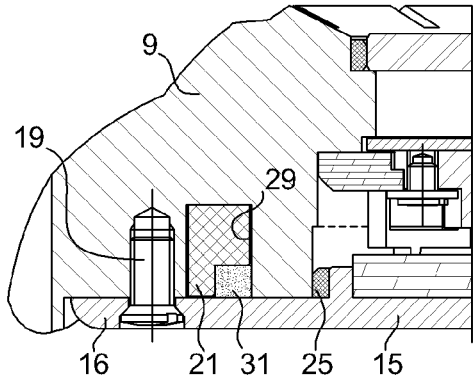
FIG. 9 corresponds to the cross-section of FIG. 6, in accordance with another embodiment.

In a variant shown in FIG. 9, it can be seen that back cover 15 and washer 26 form a single piece that both closes the case and holds ring 21 and sealing gasket 31 in place by means of screws 19 passing through lugs 16.

In the example shown in FIG. 1, cover 7 has the shape of an open L whose large arm 8*a* entirely covers the head of crown 5, in the closed position, leaving its edges visible, and entirely uncovers it in the open position shown in dotted lines. In the closed position, the end of large arm 8*a* matches the contour of a horn 17*a*.

Figure 2:
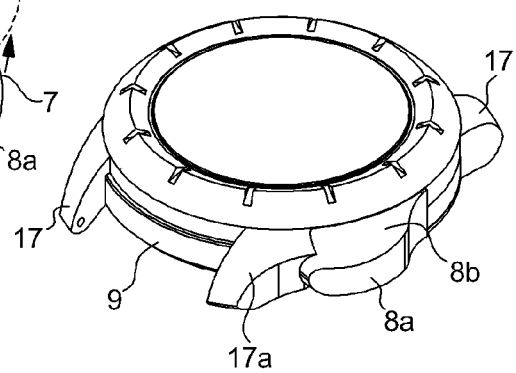
FIG. 2 shows an alternative embodiment of the crown cover device of FIG. 1.
Figure 3:
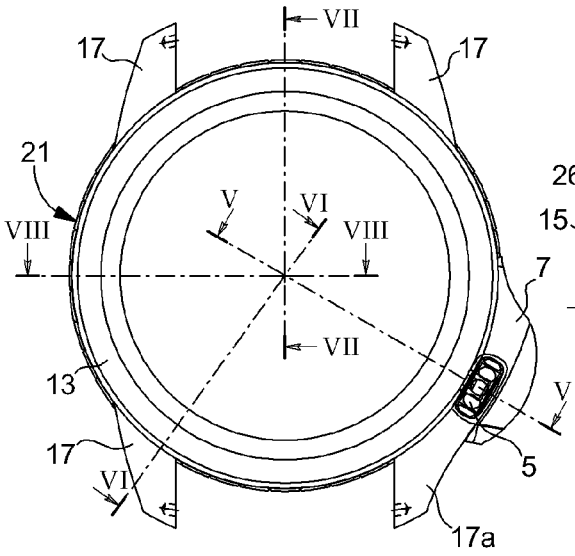
FIG. 3 is a simplified diagram of FIG. 1 in order to show the cross-sectional planes of the following Figures.
Figure 4:
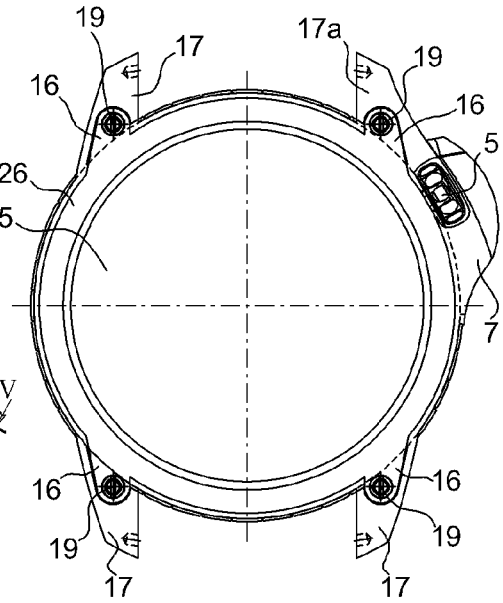
FIG. 4 is a bottom view of FIG. 1.

According to a variant shown in FIG. 2, cover 7 can further comprise a top closing element 8*b* which completely conceals crown 5 from view in the closed position. A top closing element (not shown) can also be provided such that cover 7 has the shape of a totally enveloping shell.

Figure 5:
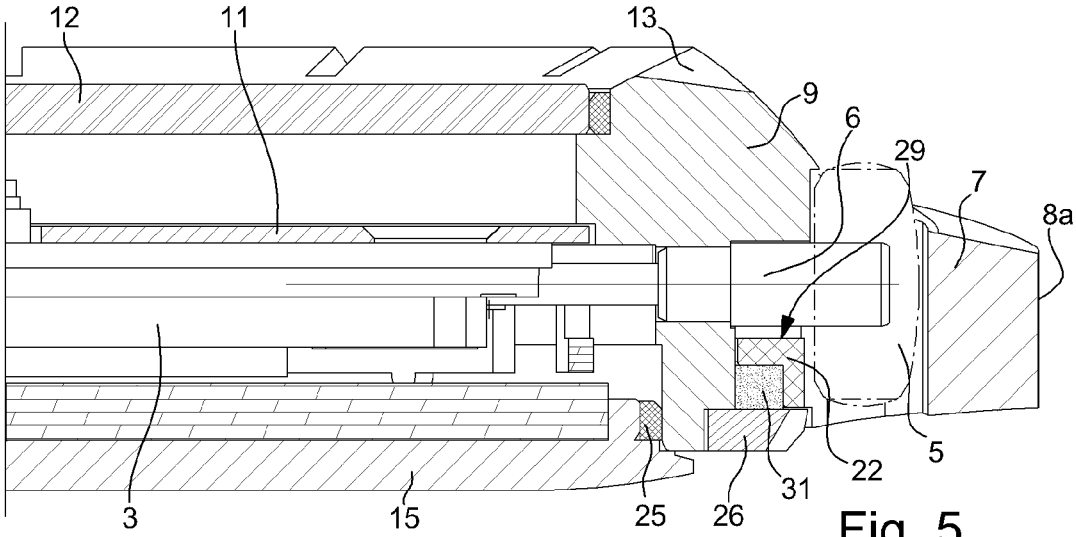
FIG. 5 is a semi cross-section along axis V-V at 4 o'clock in FIG. 3.

The cross-section of FIG. 5, taken along the axis of the winding stem 6, shows that ring 21 includes a thinned part 22 over an arc of a circle sufficient to allow cover 7 clearance between the closed position and the open position.

Figure 6:
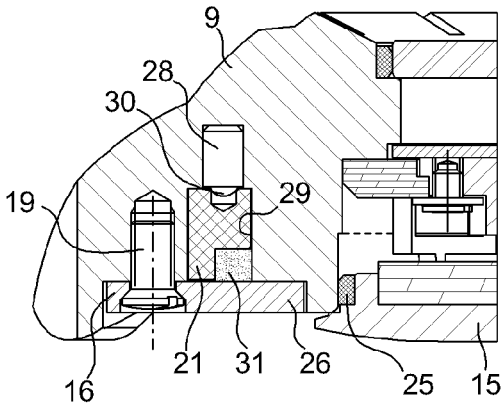
FIG. 6 is a shortened semi cross-section, along axis VI-VI at 7 o'clock in FIG. 3.
Figure 7:
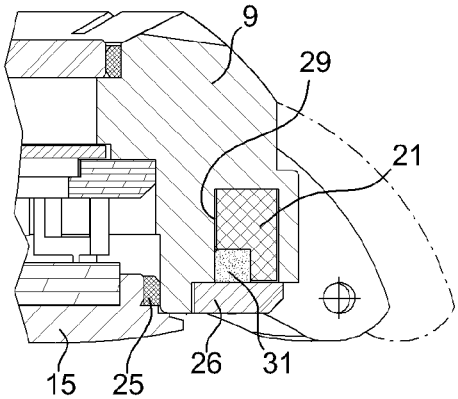
FIG. 7 is a shortened cross-section, along axis VII-VII at 12 o'clock in FIG. 3.

The cross-section of FIG. 6 shows that the device can further include a click system 28 cooperating with raised portions 30 formed in the top part of ring 21, over an arc of a circle corresponding at least to the travel of cover 7 between the closed position and the open position. In the example shown, the click is positioned at 7 o'clock but it is clear that other positions are possible, and that there can be more than one click 28.

Figure 8:
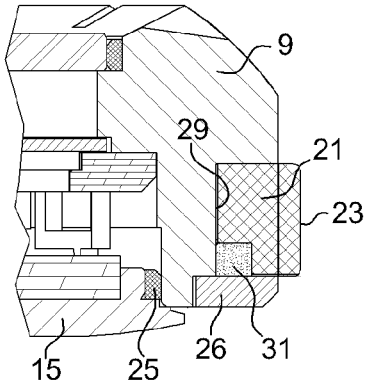
FIG. 8 is a shortened cross-section, along axis VIII-VIII at 9 o'clock in FIG. 3.

In the cross-section of FIG. 8 taken at 9 o'clock, it can be seen that annular groove 29 can be partially open outwards, manoeuvring ring 21 then be provided with notches 23 for facilitating the manoeuvring of cover 7.

Figure 10:
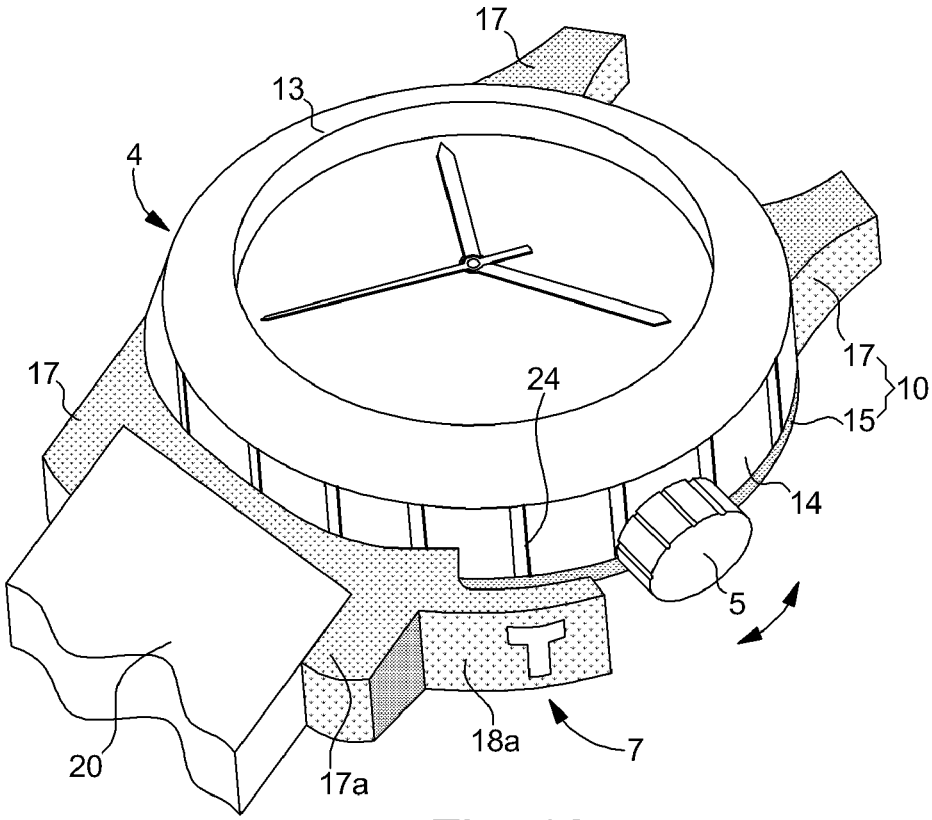
FIG. 10 shows a perspective view of a second embodiment of a crown cover device.
Figure 11:
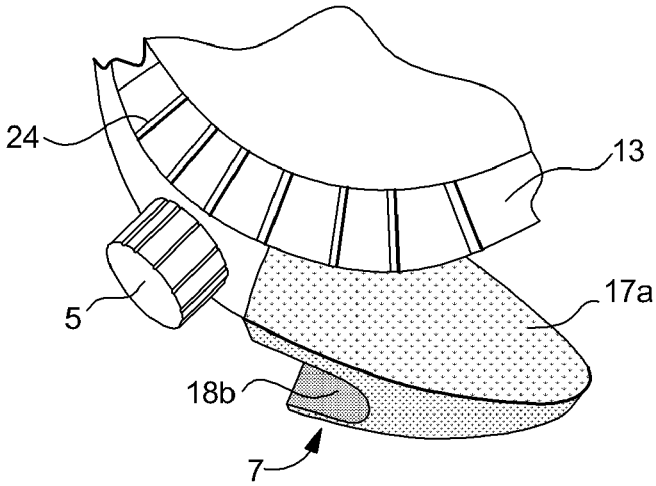
FIG. 11 shows an alternative embodiment of the crown cover shown in FIG. 10.

With reference now to FIGS. 10 and 11, a second embodiment will now be described, wherein cover 7 is fixed and crown 5 is mobile in rotation in the plane of the watch, owing to a two part design of the external casing. A first part includes a case 4 closed by a crystal 12 for housing movement 3, the winding stem 6, at the end of which crown 5 is secured, passing through the side 14 of said case. The second part is formed by a support 10 made in a single piece formed by back cover 15 connecting the four horns 17, 17*a* for attaching bracelet strands 20.

Said support 10 is for receiving case 4, the assembly being carried out with slide friction to enable said case to rotate, owing to notches 24 on the flank 14 of case 4, or on bezel 13, as shown in FIG. 10.

One of horns 17*a* includes an L-shaped extension 18*a* near the 4 o'clock position, with the large arm occupying the farthest position from the centre of the watch. Pivoting case 4 in the clockwise direction brings the head of crown 5 underneath the large arm 18*a* of cover 7, the edge of the crown remaining visible. According to a variant shown in FIG. 11, cover 7 is formed by a recess 18*b* in horn 17*a*, which allows crown 5 to be almost totally concealed.

The above description concerns embodiments wherein crown 5 or cover 7 are substantially positioned at 4 o'clock, but it is clear that other choices are possible depending upon the design of the outer casing. Likewise, it has been assumed that cover 7 is used to conceal and protect a crown 5, but this control member could very well be one or several other control members, such as push-buttons.

In the preceding description, and particularly in the second embodiment, one might question the convenience of reading the time on a dial whose 3 o'clock marking is not opposite crown 5 in the unused position when it is covered by cover 7.

In the first embodiment, it can be said that not all wristwatches have a crown positioned at 3 o'clock. By way of example, in CH Patent No. 661 404, the crown is positioned at 9 o'clock.

In the second embodiment, it is true that the rotation of case 4 shifts the hour symbols by one step clockwise. This defect can easily be corrected by shifting the hour symbol markings by one step anti-clockwise and altering the time reference accordingly.

In other words, by printing the mark and figures and/or indices on the dial, it is still possible to choose the time reference by removing the conventional 3 o'clock reference from the crown.

Other alterations can be made to the crown-protector that has just been described without departing from the scope of the present invention.

The invention claimed is:

1. A crown protection device for a wristwatch including a movement including at least, at the end of a winding stem, a crown able to be concealed by a cover provided in an external casing, formed in particular by a middle part, closed on the dial side by a crystal surrounded by a bezel, by a back cover and by horns for attaching wristband strands, wherein the cover is independent of the bezel and wherein the movement and the external casing, or an element integrated in the external casing, can be manipulated in relative rotation in the plane of the watch between a position in which the crown is concealed by the cover and a position in which it is revealed.

2. The crown protection device according to claim 1, wherein the cover is secured to a manoeuvring ring slide friction mounted in an annular groove provided in the middle part on the back cover side, wherein the horns are integral with the middle part and wherein said maneuvering ring is held in place by a base provided with lugs screwed into the horns.

3. The crown protection device according to claim 2, wherein the base is formed by a washer abutting on the edges of the annular groove.

4. The crown protection device according to claim 2, wherein the base is formed by an extension of the back cover underneath the annular groove.

5. The crown protection device according to claim 2, wherein the ring carrying the cover is provided with notches extending beyond the middle part to facilitate manipulation of said ring.

6. The crown protection device according to claim 2, wherein the ring includes a thinned part opposite the winding stem.

7. The crown protection device according to claim 2, wherein the cover is formed by a contour forming a lateral protection.

8. The crown protection device according to claim 7, wherein the cover also includes a top part for totally concealing the crown in the closed position.

9. The crown protection device according to claim 2, wherein it further includes at least one click inserted between the top part of the middle part and the ring for holding the cover in a determined position.

10. The crown protection device according to claim 2, wherein the crown is positioned at 4 o'clock and wherein the cover is stopped or abuts against a horn.

11. The crown protection device according to claim 1, wherein the wristwatch is formed of two parts, a first part including a case closed by a crystal and housing the movement, the winding stem passing through the flank of said case with a crown at the end of said stem, and a second part formed by a support in a single piece formed by a back cover and horns, one of which is shaped to form a cover for the crown when the case is pivoted in the support.

12. The crown protection device according to claim 11, wherein the cover is formed by an extension of a horn leaving one part of the crown visible in the closed position.

13. The crown protection device according to claim 11, wherein the cover is formed by a recess in one horn for completely concealing the crown in the closed position.

14. The crown protection device according to claim 11, wherein the flank of the case is provided with notches facilitating manipulation of said case.

15. The crown protection device according to claim 11, wherein the bezel of the case is provided with notches facilitating manipulation of said case.

* * * * *